US011018455B2

(12) United States Patent
Wu et al.

(10) Patent No.: US 11,018,455 B2
(45) Date of Patent: May 25, 2021

(54) CONNECTOR AND TRANSMISSION WAFER THEREOF

(71) Applicant: TOPCONN ELECTRONIC (KUNSHAN) CO., LTD., Suzhou (CN)

(72) Inventors: Kai Wu, Guangdong (CN); Che-Ting Wu, New Taipei (TW); Yueh-Lin Yang, New Taipei (TW); Chung-Nan Pao, New Taipei (TW); Chih-Wei Chen, New Taipei (TW)

(73) Assignee: STARCONN ELECTRONIC (Su Zhou) Co., LTD, Kunshan (CN)

( * ) Notice: Subject to any disclaimer, the term of this patent is extended or adjusted under 35 U.S.C. 154(b) by 0 days.

(21) Appl. No.: 16/868,542

(22) Filed: May 7, 2020

(65) Prior Publication Data

US 2021/0098939 A1 Apr. 1, 2021

(30) Foreign Application Priority Data

Sep. 26, 2019 (CN) ..... 201910919090.7

(51) Int. Cl.

| | |
|---|---|
| ***H01R 13/648*** | (2006.01) |
| ***H01R 13/6471*** | (2011.01) |
| ***H01R 13/6587*** | (2011.01) |
| ***H01R 13/518*** | (2006.01) |
| ***H01R 12/72*** | (2011.01) |
| ***H01R 12/55*** | (2011.01) |
| ***H01R 12/71*** | (2011.01) |

(52) U.S. Cl.

CPC ..... *H01R 13/6471* (2013.01); *H01R 12/55* (2013.01); *H01R 12/716* (2013.01); *H01R 12/721* (2013.01); *H01R 13/518* (2013.01); *H01R 13/6587* (2013.01)

(58) Field of Classification Search

CPC .... H01R 12/55; H01R 12/716; H01R 12/721; H01R 13/518; H01R 13/6471; H01R 13/6587

USPC ..... 429/607.01–607.4

See application file for complete search history.

(56) References Cited

U.S. PATENT DOCUMENTS 6,808,419 B1 * 10/2004 Korsunsky ..... H01R 13/6585 439/607.23

7,762,846 B1 * 7/2010 Whiteman, Jr. ..... H01R 13/514 439/607.23

(Continued)

*Primary Examiner* — Khiem M Nguyen

(74) *Attorney, Agent, or Firm* — Gang Yu

(57) ABSTRACT

A connector and a transmission wafer thereof are provided. The transmission wafer includes an insulating frame, a plurality of grounding terminals fixed to the insulating frame, and a first shielding member disposed on the insulating frame. At least one of the grounding terminals includes a main segment and a parasitic segment separate from the main segment. The main segment includes a transmission portion fixed in the insulating frame and a tail portion that protrudes from the insulating frame. The parasitic segment includes a fixing portion fixed in the insulating frame and a parasitic contact portion that protrudes from the insulating frame. The first shielding member includes a plurality of first internally connecting arms respectively connected to the grounding terminals, and at least one of the first externally connecting arms is sandwiched between a first edge of the transmission portion and a second edge of the fixing portion.

12 Claims, 14 Drawing Sheets

(56) References Cited

U.S. PATENT DOCUMENTS

| | | | | |
|---|---|---|---|---|
| 8,435,074 | B1 * | 5/2013 | Grant | H01R 13/6587 439/607.23 |
| 8,740,643 | B2 * | 6/2014 | Kuang | H01R 12/721 439/541.5 |
| 2015/0079844 | A1 * | 3/2015 | Lee | H01R 13/6587 439/607.23 |

* cited by examiner

CONNECTOR AND TRANSMISSION WAFER THEREOF

CROSS-REFERENCE TO RELATED PATENT APPLICATION

This application claims the benefit of priority to Patent Application No. 201910919090.7, filed on Sep. 26, 2019 in People's Republic of China. The entire content of the above identified application is incorporated herein by reference.

Some references, which may include patents, patent applications and various publications, may be cited and discussed in the description of this disclosure. The citation and/or discussion of such references is provided merely to clarify the description of the present disclosure and is not an admission that any such reference is "prior art" to the disclosure described herein. All references cited and discussed in this specification are incorporated herein by reference in their entireties and to the same extent as if each reference was individually incorporated by reference.

FIELD OF THE DISCLOSURE

The present disclosure relates to a connector, and more particularly to a connector and a transmission wafer thereof for transmitting signal in high speed.

BACKGROUND OF THE DISCLOSURE

A conventional connector is provided to be inserted into a mating connector for jointly transmitting signals. The conventional connector includes a plurality of transmission wafers arranged in a row, and each of the transmission wafers includes a plurality of signal terminal pairs, a plurality of grounding terminals, and an insulating frame that covers and fixes the signal terminal pairs and the grounding terminals. Specifically, in any one of the transmission wafers of the conventional connector, each of the grounding terminals is integrally formed as a one piece structure, so that a manufacturing process of the grounding terminal is more difficult, and the insulating frame for fixing the grounding terminals is difficult to manufacture.

SUMMARY OF THE DISCLOSURE

In response to the above-referenced technical inadequacies, the present disclosure provides a connector and a transmission wafer thereof to effectively improve the issues associated with conventional transmission wafers.

In one aspect, the present disclosure provides a transmission wafer of a connector. The transmission wafer includes an insulating frame, a plurality of grounding terminals, and a first shielding member. The grounding terminals are fixed to the insulating frame. At least one of the grounding terminals is defined as a split terminal that includes a main segment and a parasitic segment. The main segment includes a transmission portion fixed in the insulating frame and at least one tail portion extending from the transmission portion to protrude from the insulating frame. The transmission portion has a first edge arranged away from the at least one tail portion. The parasitic segment is separated from the main segment. The parasitic segment includes a fixing portion fixed in the insulating frame and at least one parasitic contact portion extending from the fixing portion to protrude from the insulating frame. The fixing portion has a second edge arranged away from the at least one parasitic contact portion, and the first edge and the second edge face each other and have an elongated gap there-between. The first shielding member is disposed on a side surface of the insulating frame and includes a plurality of first internally connecting arms respectively connected to the grounding terminals. At least one of the first internally connecting arms is inserted into the elongated gap, and connects to the first edge and the second edge.

In one aspect, the present disclosure provides a connector, which includes a housing and a plurality of transmission wafers. The transmission wafers are arranged in one row and are inserted into the housing. At least one of the transmission wafers includes an insulating frame, a plurality of grounding terminals, and a first shielding member. The grounding terminals are fixed to the insulating frame. At least one of the grounding terminals is defined as a split terminal that includes a main segment and a parasitic segment. The main segment includes a transmission portion fixed in the insulating frame and at least one tail portion extending from the transmission portion to protrude from the insulating frame. The transmission portion has a first edge arranged away from the at least one tail portion. The parasitic segment is separated from the main segment. The parasitic segment includes a fixing portion fixed in the insulating frame and at least one parasitic contact portion extending from the fixing portion to protrude from the insulating frame. The fixing portion has a second edge arranged away from the at least one parasitic contact portion, and the first edge and the second edge face each other and have an elongated gap there-between. The first shielding member is disposed on a side surface of the insulating frame and includes a plurality of first internally connecting arms respectively connected to the grounding terminals. At least one of the first internally connecting arms is inserted into the elongated gap, and connects to the first edge and the second edge.

Therefore, at least one of the grounding terminals of the transmission wafer of the connector in the present disclosure is formed into two separated segments (i.e., the main segment and the parasitic segment), so that the grounding terminals and the insulating frame can be manufactured more easily. Specifically, the parasitic segment and the main segment of the split terminal can be electrically connected to each other through the corresponding first internally connecting arm sandwiched there-between, so that the electrical connection of the parasitic segment and the main segment have a short signal transmitting path to effectively inhibit the crosstalk.

The foregoing description of the exemplary embodiments of the disclosure has been presented only for the purposes of illustration and description and is not intended to be exhaustive or to limit the disclosure to the precise forms disclosed. Many modifications and variations are possible in light of the above teaching.

These and other aspects of the present disclosure will become apparent from the following description of the embodiment taken in conjunction with the following drawings and their captions, although variations and modifications therein may be affected without departing from the spirit and scope of the novel concepts of the disclosure.

BRIEF DESCRIPTION OF THE DRAWINGS

The present disclosure will become more fully understood from the following detailed description and accompanying drawings.

DETAILED DESCRIPTION OF THE EXEMPLARY EMBODIMENTS

Figure 1:
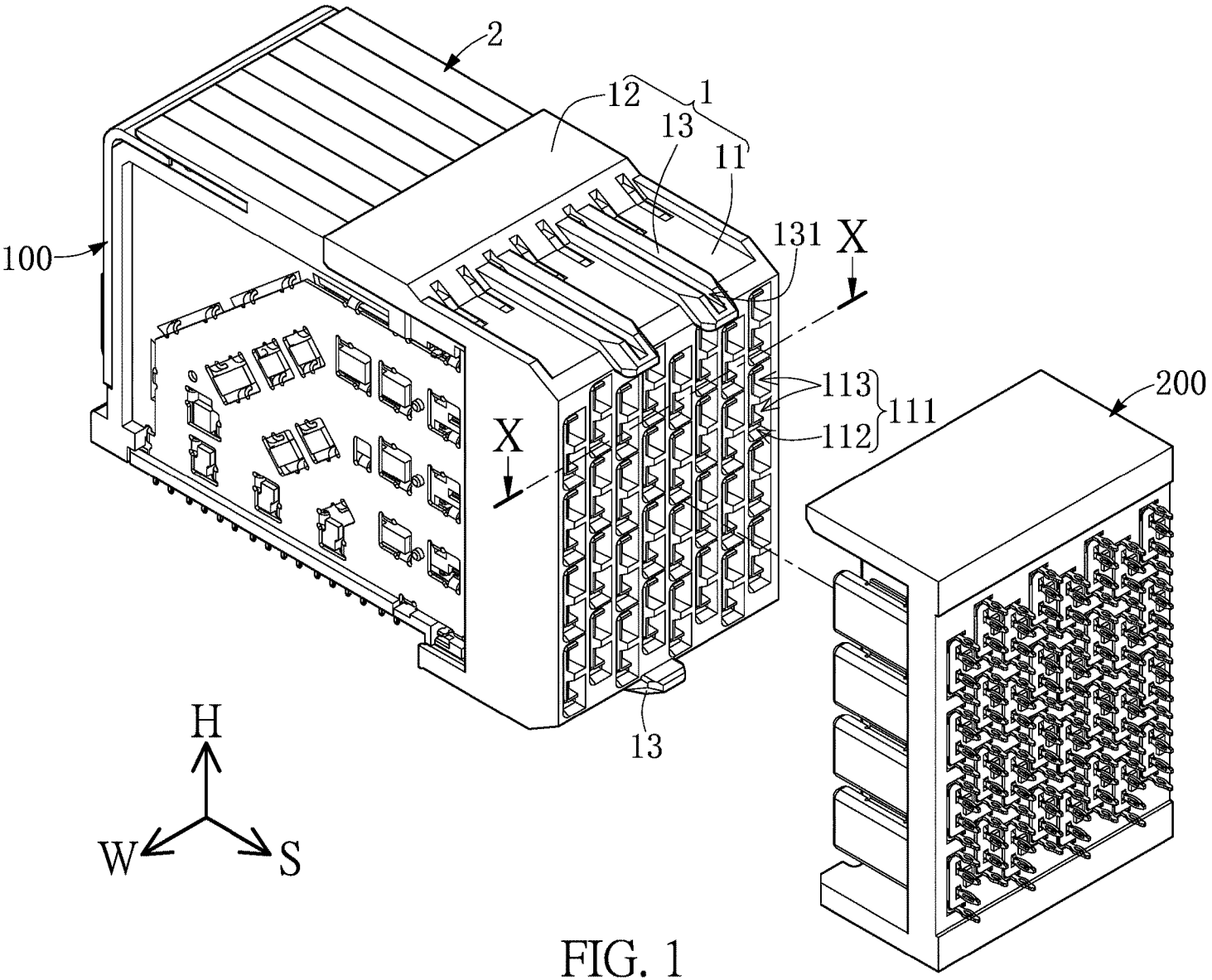
FIG. 1 is a perspective view of a connector and a mating connector according to a first embodiment of the present disclosure.

The present disclosure is more particularly described in the following examples that are intended as illustrative only since numerous modifications and variations therein will be apparent to those skilled in the art. Like numbers in the drawings indicate like components throughout the views. As used in the description herein and throughout the claims that follow, unless the context clearly dictates otherwise, the meaning of "a", "an", and "the" includes plural reference, and the meaning of "in" includes "in" and "on". Titles or subtitles can be used herein for the convenience of a reader, which shall have no influence on the scope of the present disclosure.

The terms used herein generally have their ordinary meanings in the art. In the case of conflict, the present document, including any definitions given herein, will prevail. The same thing can be expressed in more than one way. Alternative language and synonyms can be used for any term(s) discussed herein, and no special significance is to be placed upon whether a term is elaborated or discussed herein. A recital of one or more synonyms does not exclude the use of other synonyms. The use of examples anywhere in this specification including examples of any terms is illustrative only, and in no way limits the scope and meaning of the present disclosure or of any exemplified term. Likewise, the present disclosure is not limited to various embodiments given herein. Numbering terms such as "first", "second" or "third" can be used to describe various components, signals or the like, which are for distinguishing one component/signal from another one only, and are not intended to, nor should be construed to impose any substantive limitations on the components, signals or the like.

First Embodiment

Referring to FIG. 1 to FIG. 10, a first embodiment of the present disclosure provides a connector 100 configured to be detachably inserted into a mating connector 200 along an insertion direction S, and the connector 100 can be a high speed (or high frequency) connector applied to a server or a switchboard, but the present disclosure is not limited thereto. In order to easily describe the present embodiment, the connector 100 further defines a width direction W and a height direction H both perpendicular to each other and perpendicular to the insertion direction S.

Figure 2:
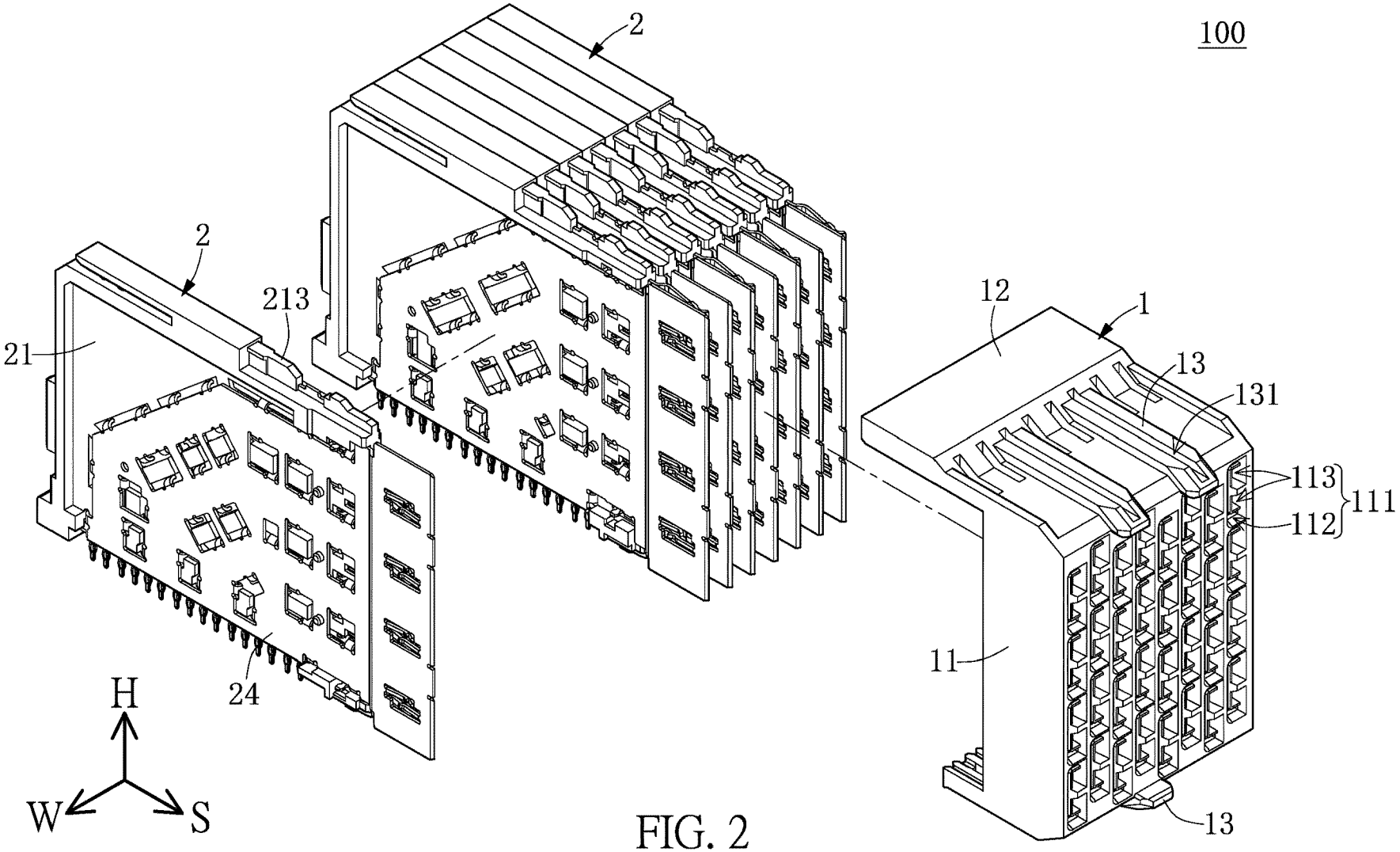
FIG. 2 is an exploded view of the connector according to the first embodiment of the present disclosure.

As shown in FIG. 1 and FIG. 2, the connector 100 includes a housing 1 and a plurality of transmission wafers 2 inserted into the housing 1. The transmission wafers 2 of the present embodiment are arranged in one row along the width direction W. In addition, any one of the transmission wafers 2 of the present embodiment is in cooperation with the housing 1, but any one of the transmission wafers 2 can be individually applied or can be applied to other components in other embodiments of the present disclosure.

The housing 1 includes an insertion portion 11 being substantially a cuboid, a positioning board 12 extending from a top end of the insertion portion 11 along the insertion direction S, and a plurality of guiding columns 13 respectively formed in a staggered arrangement on two opposite surfaces of the insertion portion 11 (e.g., two opposite surfaces can be a top surface and a bottom surface of the insertion portion 11). The insertion portion 11 has a plurality of terminal holes 111 penetratingly recessed in a front surface thereof and arranged in a plurality of rows, and each of the rows of the terminal holes 111 corresponds in position to one of the transmission wafers 2. In other words, each of the rows of the terminal holes 111 has a longitudinal direction parallel to the height direction H. Each of the rows of the terminal holes 111 includes a plurality of grounding thru-holes 112 and a plurality of signal thru-holes 113. Each of the grounding thru-holes 112 is substantially U-shaped, and two of the signal thru-holes 113 adjacent to each other are arranged at an inner side of the U-shaped grounding thru-holes 112, but the present disclosure is not limited thereto. In other embodiments of the present disclosure, the shape of each of the grounding thru-holes 112 can be similar to the shape of each of the signal thru-holes 113, so that, in the same row, the grounding thru-holes 112 and the signal thru-holes 113 can be arranged adjacent to each other and can be arranged side by side.

A longitudinal direction of each of the guiding columns 13 is parallel to the insertion direction S. The staggered arrangement of the guiding columns 13 refers to two orthogonal projection regions defined or obtained by orthogonally projecting any two of the guiding columns 13 respectively disposed on the top surface and the bottom surface of the insertion portion 11 in the height direction H are not overlapped with each other. In other words, as shown in FIG. 2, one of the guiding columns 13 is arranged at a top side of a third row of the terminal holes 111 counting from FIG. 2, and another one of the guiding columns 13 is arranged at a bottom side of a fourth row of the terminal holes 111 counting from of FIG. 2.

Moreover, one end of each of the guiding columns 13 protrudes from the insertion portion 11, and the other end of each of the guiding columns 13 is connected to the positioning board 12. Each of the guiding columns 13 has a groove 131 recessed from the end thereof protruding from the insertion portion 11 and extending along the insertion direction S.

Figure 3:
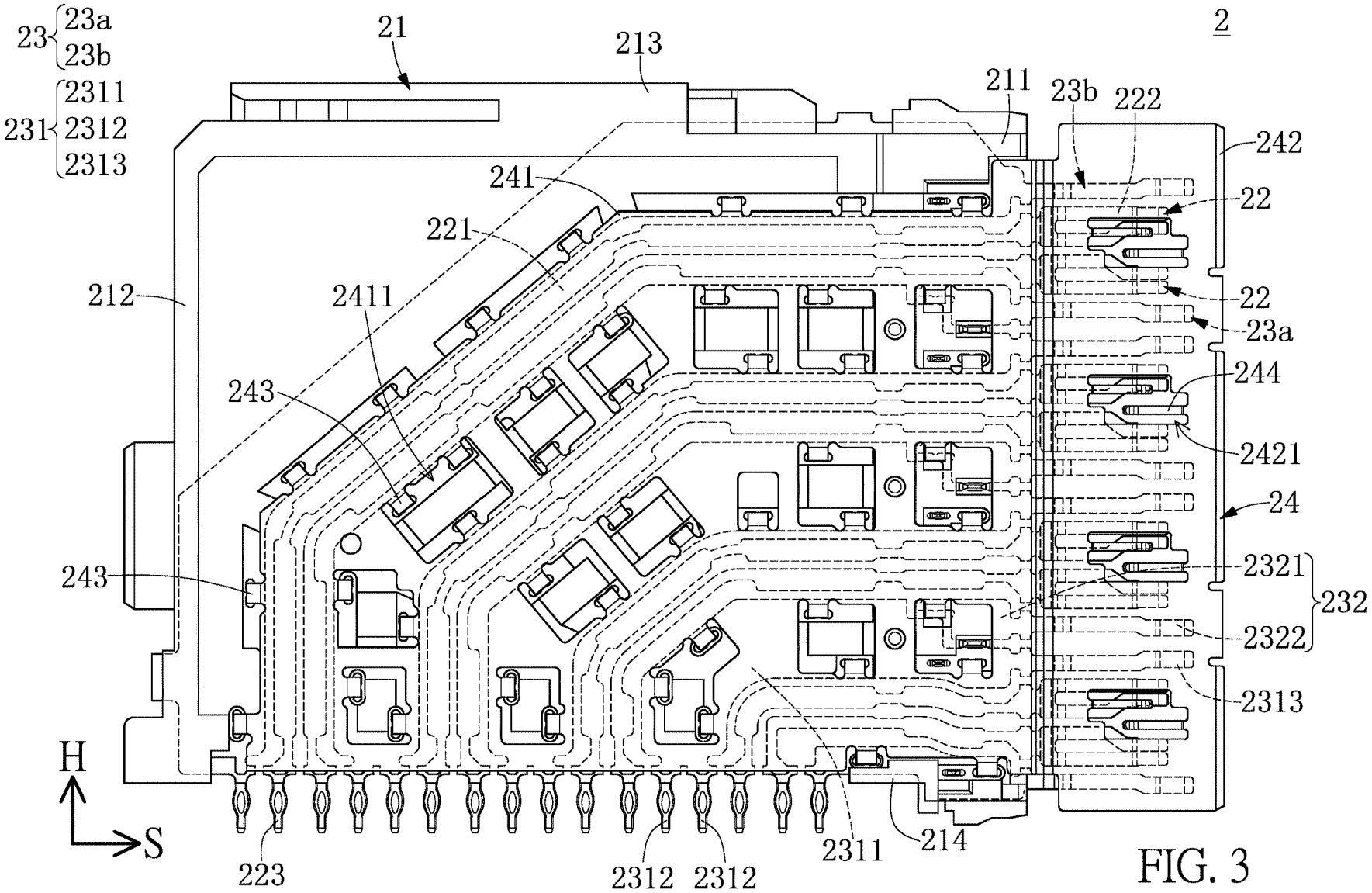
FIG. 3 is a planar view showing a transmission wafer of FIG. 2.
Figure 4:
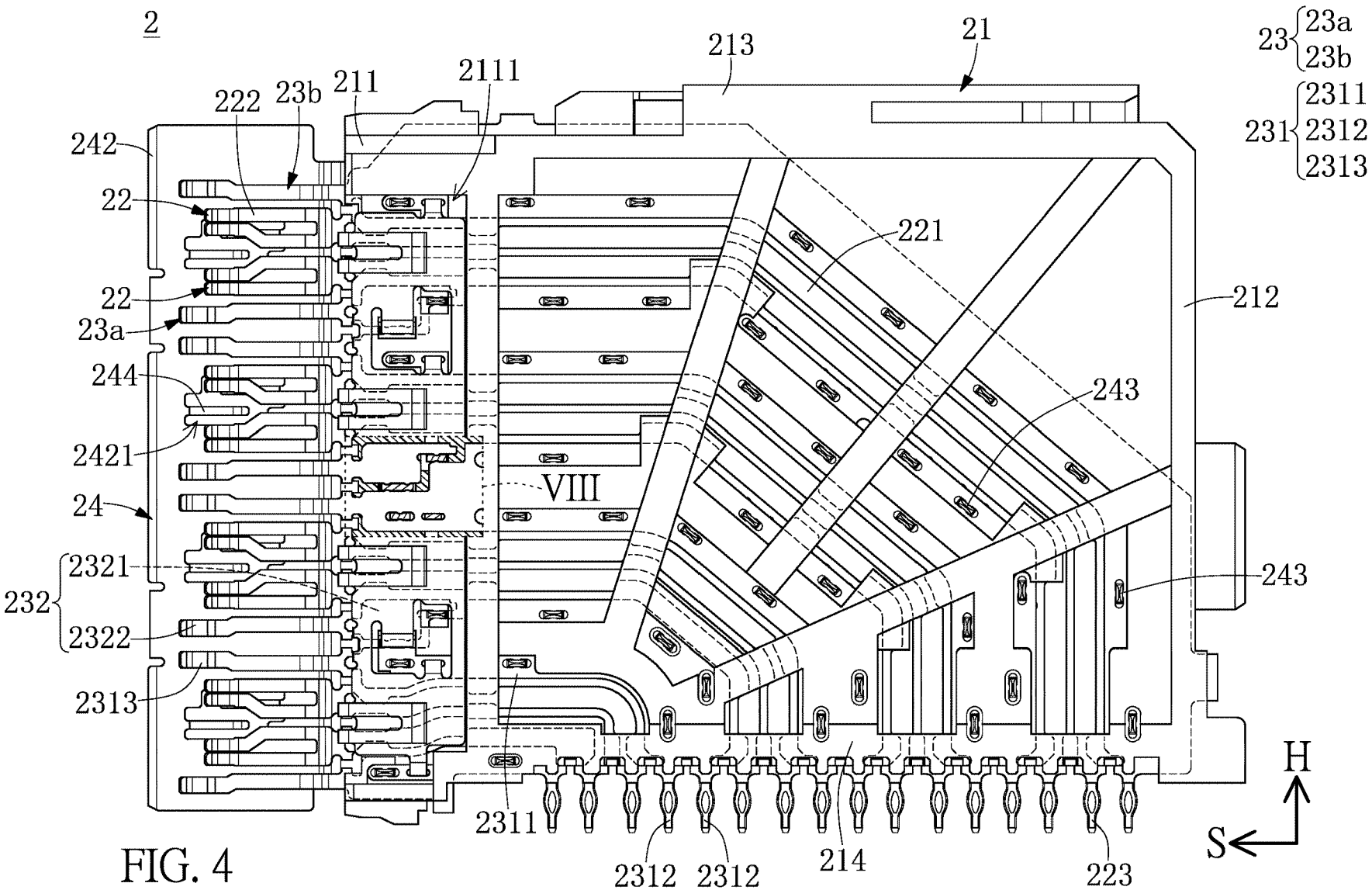
FIG. 4 is a planar view showing the transmission wafer of FIG. 2 in another angle of view.

As shown in FIG. 2 to FIG. 4, the transmission wafers 2 are inserted into the insertion portion 11 of the housing 1, and are engaged with the positioning board 12 of the housing 1. The transmission wafers 2 can substantially have the same structures, the following description discloses the structure of only one of the transmission wafers 2 for the sake of brevity, but the present disclosure is not limited thereto. For example, in other embodiments of the present disclosure, the structures of the transmission wafers 2 of the connector 100 can be different.

Figure 5:
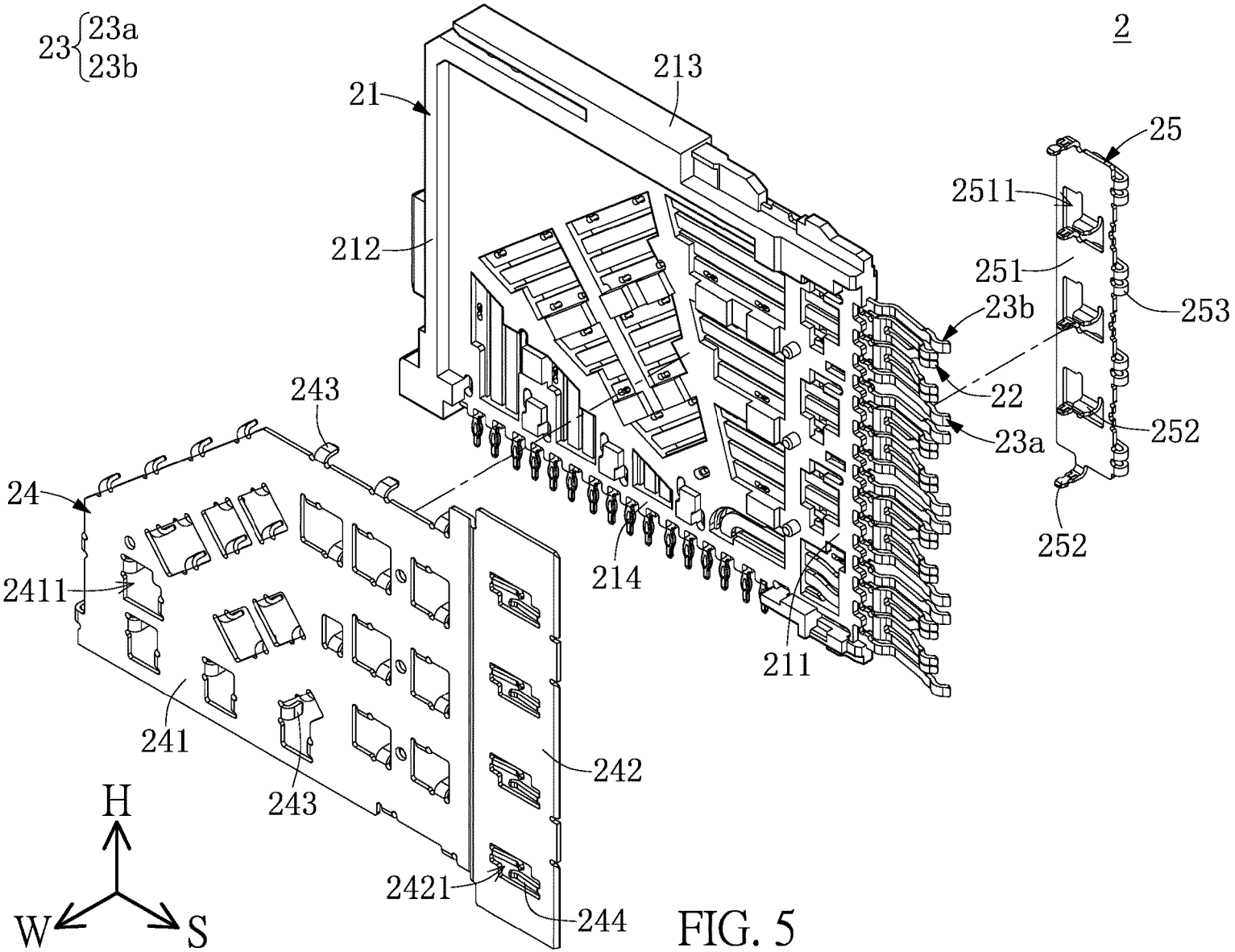
FIG. 5 is an exploded view showing the transmission wafer of FIG. 2.
Figure 6:
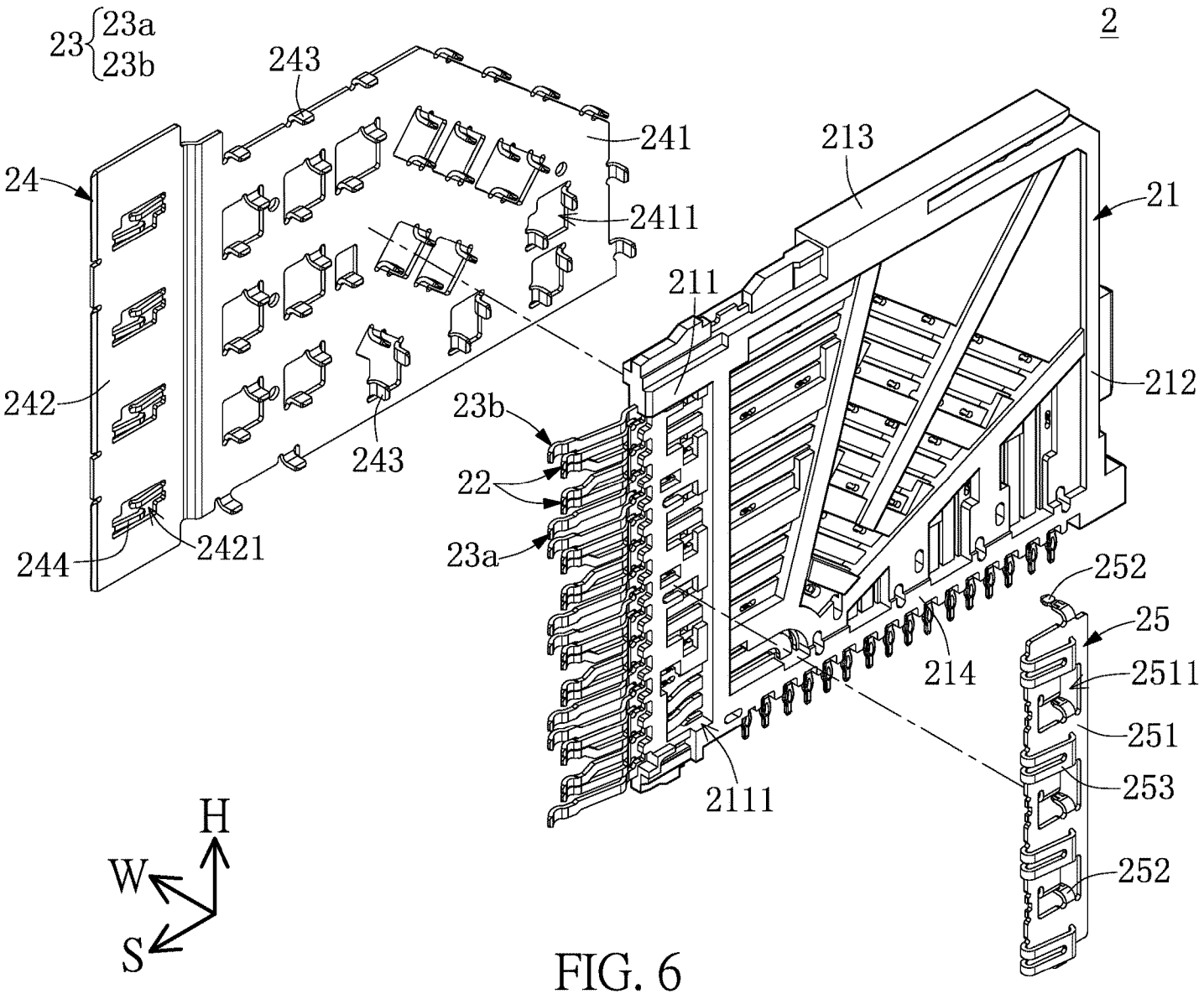
FIG. 6 is an exploded view showing the transmission wafer of FIG. 2 in another angle of view.

As shown in FIG. 2, FIG. 5, and FIG. 6, the transmission wafer 2 of the present embodiment includes an insulating frame 21 having a substantial rectangular shape, a plurality of signal terminals 22 fixed to the insulating frame 21, a plurality of grounding terminals 23 fixed to the insulating frame 21, a first shielding member 24, and a second shielding member 25. Moreover, the first shielding member 24, and a second shielding member 25 are respectively disposed on two opposite sides of the insulating frame 21.

The insulating frame 21 includes a front end portion 211, a rear end portion 212, a top end portion 213, and a bottom end portion 214, which are disposed around a peripheral region of the insulating frame 21 and each have an elongated shape. A longitudinal direction of the front end portion 211 and a longitudinal direction of the rear end portion 212 are substantially parallel to the height direction H, and a longitudinal direction of the top end portion 213 and a longitudinal direction of the bottom end portion 214 are substantially parallel to the insertion direction S. In other words, the longitudinal direction of the front end portion 211 is substantially perpendicular to that of the bottom end portion 214.

Specifically, the insulating frame 21 has an accommodating slot 2111 recessed in the front end portion 211. The accommodating slot 2111 of the present embodiment is an elongated structure parallel to the height direction H for receiving the second shielding member 25. The top end portion 213 of the insulating frame 21 is engaged with the positioning board 12, and the bottom end portion 214 of the insulating frame 21 is engaged with the insertion portion 11.

Figure 7:
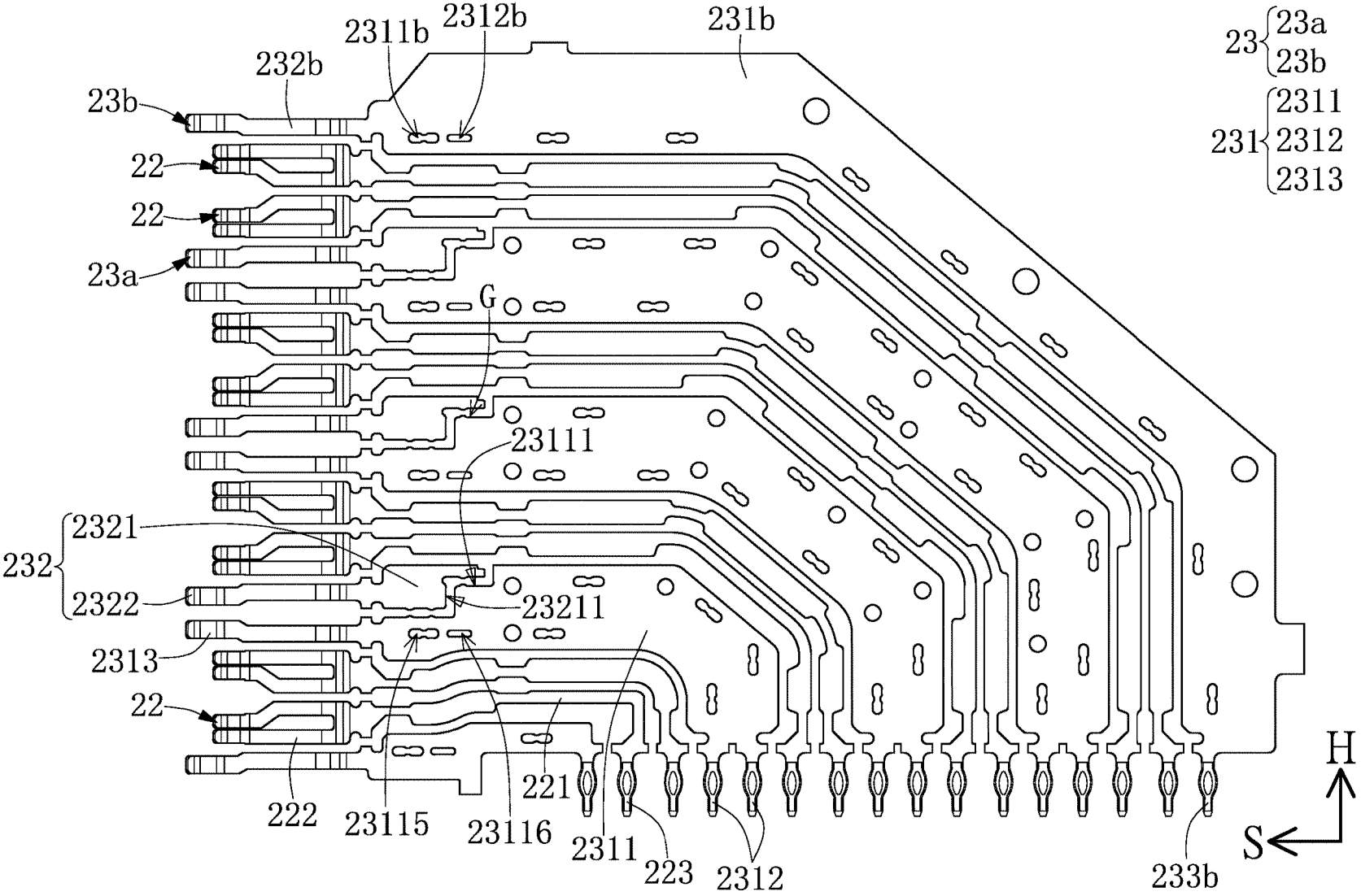
FIG. 7 is a planar view showing the transmission wafer of FIG. 2 when an insulating frame is omitted therefrom.

As shown in FIG. 3, FIG. 4, and FIG. 7, each of the signal terminals 22 is integrally formed as a one-piece structure, and includes a middle signal portion 221 fixed in the insulating frame 21, a front signal portion 222 extending (e.g., extending perpendicularly) from one end of the middle signal portion 221 to protrude from the front end portion 211, and a rear signal portion 223 extending (e.g., extending perpendicularly) from the other end of the middle signal portion 221 to protrude from the bottom end portion 214.

Moreover, the grounding terminals 23 and the signal terminals 22 are disposed in a staggered arrangement, and two of the signal terminals 22 (i.e., a differential signal pair) used to jointly transmit differential signals are disposed between any two of the grounding terminals 23 adjacent to each other. In the present embodiment, one of the grounding terminals 23 disposed between any two of the signal terminals 22 adjacent to each other (or any two adjacent differential signal pairs) is defined as a split terminal 23*a*.

The split terminal 23*a* includes a main segment 231 and a parasitic segment 232 that is separated from the main segment 231. Two of the grounding terminals 23 arranged at the outset side of the transmission wafer 2 are each integrally formed as a one-piece structure and defined as a single terminal 23*b*, but the present disclosure is not limited thereto. For example, in other embodiments of the present disclosure, the number of the split terminals 23*a* in the transmission wafer 2 can be at least one; that is to say, at least one of the grounding terminals 23 can be the split terminal 23*a*.

The split terminals 23*a* have the same or similar structures, the following description discloses the structure of only one of the split terminals 23*a* for the sake of brevity, but the present disclosure is not limited thereto. For example, in other embodiments of the present disclosure, the structures of the split terminals 23*a* of the transmission wafer 2 can be different.

The main segment 231 includes a transmission portion 2311 fixed in the insulating frame 21, two tail portions 2312 extending from the transmission portion 2311 to protrude from the insulating frame 21, and a main contact portion 2313 that extends from the transmission portion 2311 along a direction away from the two tail portions 2312 to protrude from the insulating frame 21. The main segment 231 of the present embodiment is provided with the two tail portions 2312, but in other embodiments of the present disclosure, the number of the tail portions 2312 of the main segment 231 can be at least one.

Figure 8:
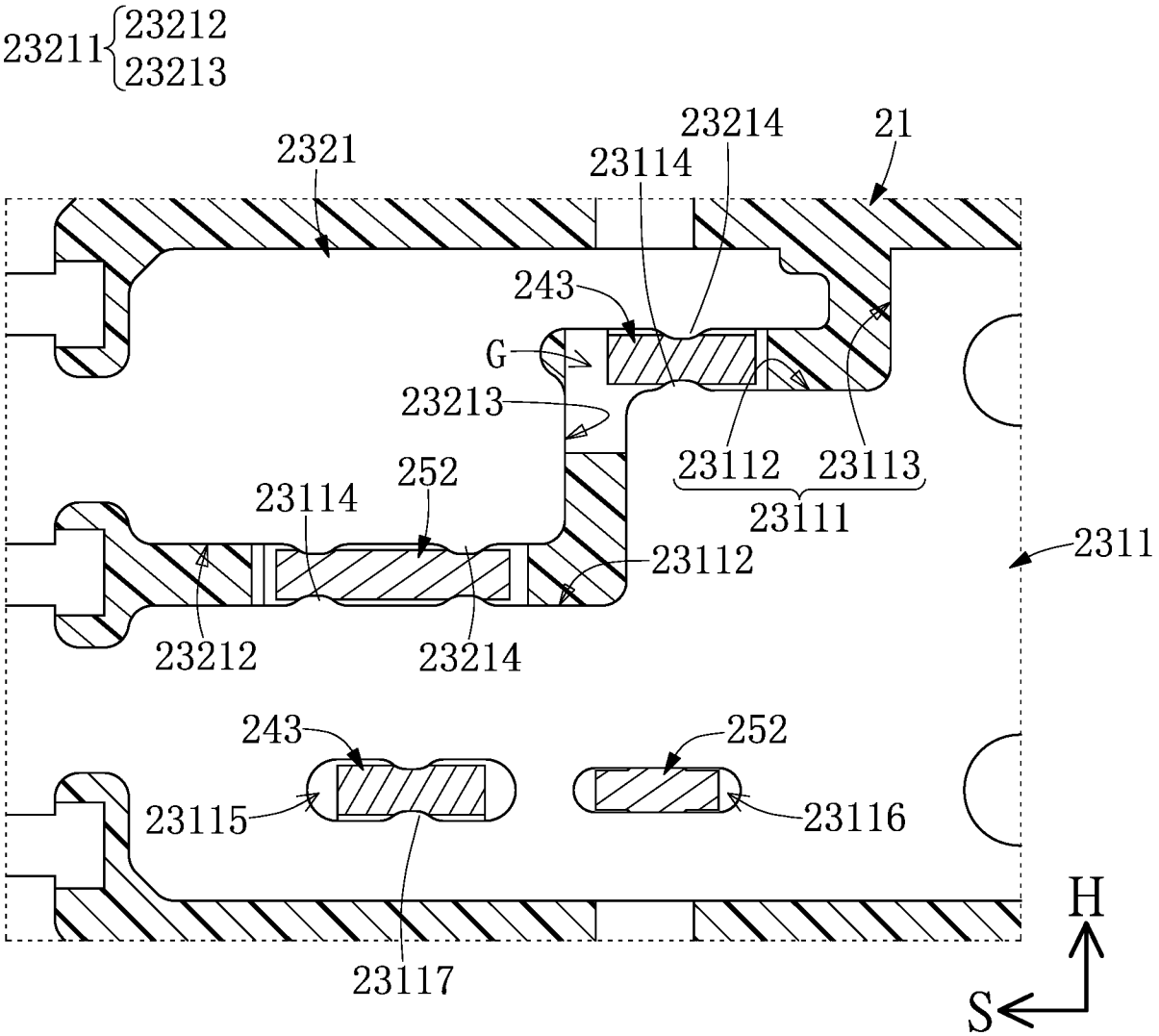
FIG. 8 is an enlarged view of portion VIII of FIG. 4.

As shown in FIG. 4, FIG. 7, and FIG. 8, the transmission portion 2311 has a first edge 23111 arranged away from the two tail portions 2312, and the first edge 23111 of the present embodiment is in a step-like shape. In the present embodiment, the first edge 23111 has a plurality of transverse parts 23112 and a plurality of erect parts 23113 connected to the transverse parts 23112. Each of the transverse parts 23112 of the first edge 23111 is parallel to the insertion direction S, and each of the erect parts 23113 of the first edge 23111 is parallel to the height direction H, but the present disclosure is not limited thereto. For example, in other embodiments of the present disclosure, the number of the transverse parts 23112 and the number of the erect parts 23113 can each be at least one, and the first edge 23111 can be in other shapes (e.g., a wavy shape, an L shape, or an arc shape) other than the step-like shape.

Moreover, the first edge 23111 in the present embodiment has a plurality of first interference parts 23114 (e.g., protrusions) respectively formed on the transverse parts 23112, but the present disclosure is not limited thereto. For example, in other embodiments of the present disclosure, the number of the first interference parts 23114 of the first edge 23111 can be at least one; or, the first edge 23111 can have at least one first interference part 23114 formed on any one of the erect parts 23113.

In addition, the transmission portion 2311 has a plurality of first thru-holes 23115 spaced apart from each other and a second thru-hole 23116 that is disposed adjacent to the first edge 23111. One of the first thru-holes 23115 and the second thru-hole 23116 are disposed formed in a region of the transmission portion 2311 corresponding in position to the front end portion 211, and the other first thru-holes 23115 are arranged in two rows to correspond in position to the two tail portions 2312 along a longitudinal direction of the transmission portion 2311.

Specifically, an inner wall of each of the first thru-holes 23115 has two protrusions 23117 (shown in FIG. 8) mutually faced and arranged at a center portion thereof. In other words, the inner wall of the first thru-hole 23115 in the present embodiment is in the shape of a doggy bone, but the present disclosure is not limited thereto. For example, an inner wall of the second thru-hole 23116 in the present embodiment does not have any protrusion.

Moreover, the main contact portion 2313 is formed by extending from an edge of the transmission portion 2311 disposed in the left side of the transmission portion 2311 (shown in FIG. 7) and disposed away from the two tail portions 2312, and the main contact portion 2313 in the present embodiment is a cantilever structure. Accordingly, when the connector 100 is inserted into the mating connector 200, the main contact portion 2313 can be forced to elastically swing.

As shown in FIG. 4, FIG. 7, and FIG. 8, the parasitic segment 232 includes a fixing portion 2321 fixed in the insulating frame 21 and a parasitic contact portion 2322 extending from the fixing portion 2321 to protrude from the insulating frame 21. The first edge 23111 defines a notch located at a corner of the transmission portion 2311, and the fixing portion 2321 is disposed in the notch and is spaced apart from the transmission portion 2311. In other words, a maximum width of the fixing portion 2321 in the height direction H is less than a maximum width of the main segment 231 in the height direction H.

The fixing portion 2321 has a second edge 23211 arranged away from the parasitic contact portion 2322. The first edge 23111 and the second edge 23211 face each other and have an elongated gap G therebetween. In the present embodiment, the second edge 23211 is in a step-like shape, and the first edge 23111 geometrically corresponds to the second edge 23211. In other words, the elongated gap G is also in a step-like shape that corresponds to the shapes of the first edge 23111 and the second edge 23211.

Specifically, the second edge 23211 has a plurality of transverse parts 23212 and a plurality of erect parts 23213 connected to the transverse parts 23212. Each of the transverse parts 23212 of the second edge 23211 is parallel to the insertion direction S, and each of the erect parts 23213 of the second edge 23211 is parallel to the height direction H, but the present disclosure is not limited thereto. For example, in other embodiments of the present disclosure, the number of the transverse parts 23212 and the number of the erect parts 23213 of the second edge 23211 can each be at least one, and the second edge 23211 can be in other shapes (e.g., a wavy shape, an L shape, or an arc shape) other than the step-like shape.

Moreover, the transverse parts 23112 of the first edge 23111 respectively face the transverse parts 23212 of the second edge 23211, and the erect parts 23113 of the first edge 23111 respectively face the erect parts 23213 of the second edge 23211. The second edge 23211 in the present embodiment has a plurality of second interference parts 23214 (e.g., protrusions) respectively formed on the transverse parts 23212, and the second interference parts 23214 of the second edge 23211 respectively face the first interference parts 23114 of the first edge 23111 along the height direction H, but the present disclosure is not limited thereto. For example, in other embodiments of the present disclosure, the number of the second interference parts 23214 of the second edge 23211 can be at least one; or, the second edge 23211 can have at least one second interference parts 23214 formed on any one of the erect parts 23213.

Figure 9:
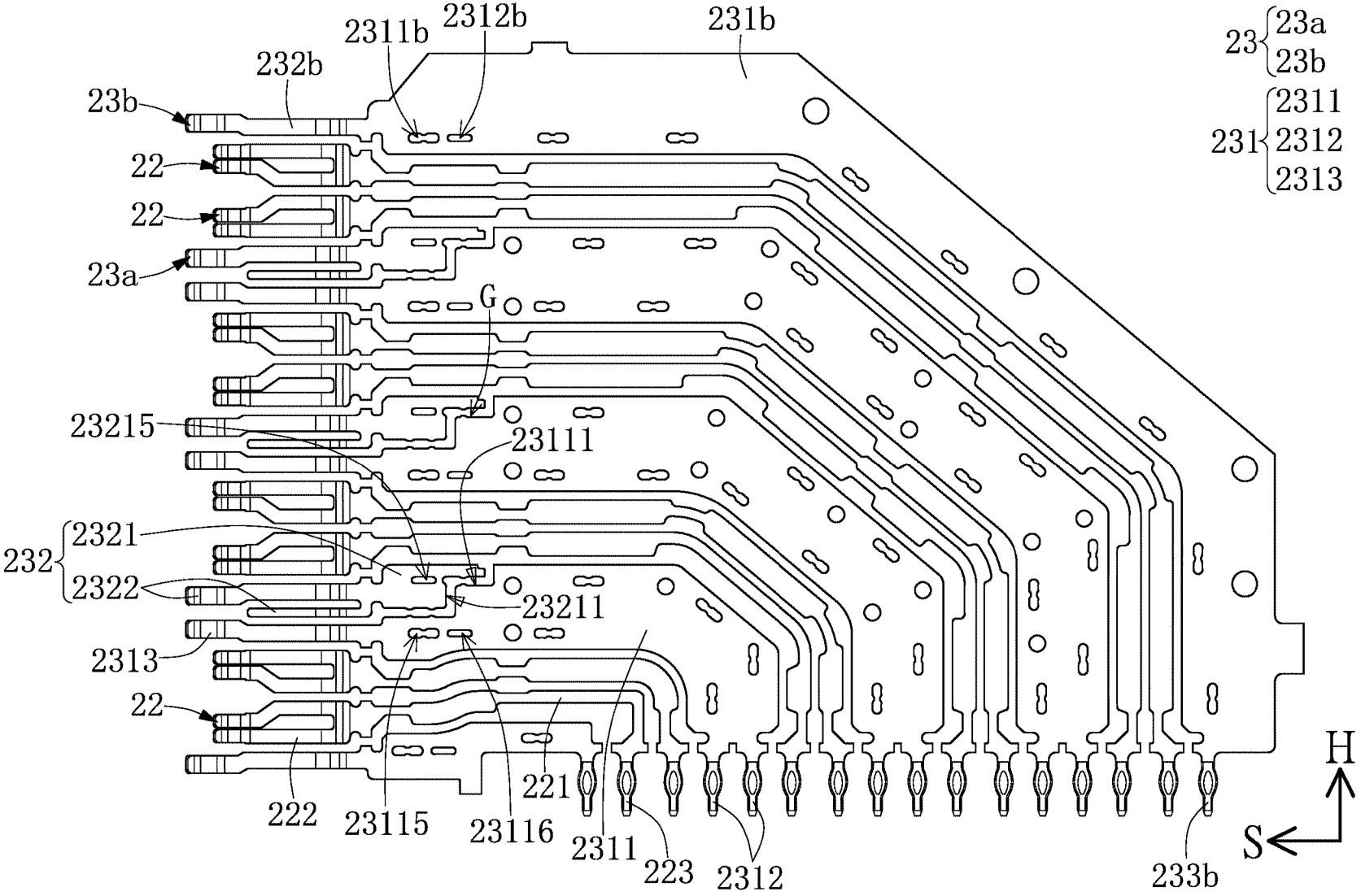
FIG. 9 is a planar view showing a different configuration of FIG. 7.

In addition, the fixing portion 2321 of the parasitic segment 232 in the present embodiment does not have any thru-hole, but the present disclosure is not limited thereto. For example, as shown in FIG. 9, the fixing portion 2321 can have a thru-hole 23215 for an insertion of the second shielding member 25 (e.g., a second internally connecting arm 252), and the structure or the shape of the thru-hole 23215 is similar to that of the second thru-hole 23116.

As shown in FIG. 4, FIG. 7, and FIG. 8, two ends of the elongated gap G are provided with parts of the insulating frame 21 therein, and a portion of the main segments 231 and a portion of the parasitic segment 232 adjacent to the two ends of the elongated gap G are embedded in the insulating frame 21, so that the split terminal 23*a* can be firmly fixed to the insulating frame 21. Moreover, the first interference parts 23114 of the main segments 231 and the second interference parts 23214 of the parasitic segment 232 are exposed from the insulating frame 21 via the elongated gap G thereby providing for insertion of the first shielding member 24 and the second shielding member 25.

In addition, the parasitic contacting portion 2322 is formed by extending from an edge of the fixing portion 2321 disposed in the left side of the fixing portion 2321 (shown in FIG. 7) and arranged away from the two tail portions 2312. The main contact portion 2313 and the parasitic contact portion 2322 are spaced apart from and adjacent to each other, and the parasitic contacting portion 2322 in the present embodiment is a cantilever structure. Accordingly, when the connector 100 is inserted into the mating connector 200, the parasitic contacting portion 2322 can be forced to elastically swing.

The number of the parasitic contacting portions 2322 of the parasitic segment 232 shown in FIG. 7 is only one, but the present disclosure is not limited thereto. For example, as shown in FIG. 9, the number of the parasitic contact portions 2322 of the parasitic segment 232 is two. In other words, the number of the parasitic contact portions 2322 of the parasitic segment 232 can be more than one.

As shown in FIG. 4, FIG. 7, and FIG. 8, the two of the grounding terminals 23 arranged at the outset side of the transmission wafer 2 (i.e., the two single terminals 23*b*) each include a middle grounding portion 231*b* fixed in the insulating frame 21, a front grounding portion 232*b* extending (e.g., extending perpendicularly) from one end of the middle grounding portion 231*b* to protrude from the front end portion 211, and a rear grounding portion 233*b* extending (e.g., extending perpendicularly) from the other end of the middle grounding portion 231*b* to protrude from the bottom end portion 214. The front grounding portion 232*b* in the present embodiment is a cantilever structure, so that when the connector 100 is inserted into the mating connector 200, the front grounding portion 232*b* can be forced to elastically swing. Moreover, the middle grounding portion 231*b* has a plurality of first thru-holes 2311*b* and a second thru-hole 2312*b*. Structures of the first thru-holes 2311*b* and the second thru-hole 2312*b* formed in the middle grounding portion 231*b* are substantially similar to the structures of the first thru-holes 23115 and the second thru-hole 23116 of the split terminal 23*a*.

As shown in FIG. 5 and FIG. 6, each of the first shielding member 24 and the second shielding member 25 in the present embodiment is integrally formed as a one-piece structure and is formed by punching and bending a metal sheet. The size of the first shielding member 24 is larger than that of the second shielding member 25. The first shielding member 24 includes a middle grounding sheet 241, a front grounding sheet 242 extending from a front edge of the middle grounding sheet 241, a plurality of first internally connecting aims 243 curvedly extending from the middle grounding sheet 241, and a plurality of first externally connecting arms 244 curvedly extending from the middle grounding sheet 242.

Specifically, each of the middle grounding sheet 241 and the front grounding sheet 242 has a plurality of first openings 2411, 2421. The first internally connecting arms 243 substantially and perpendicularly extend from peripheral edges of the middle grounding sheet 241 and inner walls of the first openings 2411, respectively. The first externally connecting arms 244 extend from inner walls of the first openings 2421 of the front grounding sheet 242, respectively.

The middle grounding sheet 241 of the first shielding member 24 is disposed on a side surface of the insulating frame 21, and the first shielding member 24 is connected to the grounding terminals 23 in accordance with the first internally connecting arms 243, so that the first shielding member 24 can be electrically connected to each of the grounding terminals 23. In the present embodiment, the first internally connecting arms 243 are respectively inserted into and fixed to the elongated gaps G and the first thru-holes 23115, 2311*b* of the grounding terminals 23 (shown in FIG. 7 and FIG. 8) for connecting the first shielding member 24 and the grounding terminals 23.

Moreover, as shown in FIG. 3, a projection region obtained or defined by orthogonally projecting the middle signal portion 221 of each of the signal terminals 22 onto the first shielding member 24 is located inside of an outer contour (e.g., an outer contour of the middle grounding sheet 241) of the first shielding member 24.

As shown in FIG. 4 to FIG. 6, the second shielding member 25 includes a plate 251, a plurality of second internally connecting arms 252 curvedly extending from the plate 251, and a plurality of second externally connecting arms 253 curvedly extending from the plate 251. In the present embodiment, the plate 251 is substantially in a rectangular shape and has a plurality of second openings 2511 formed therein. The plate 251 includes two opposite long edges and two opposite short edges that are perpendicular to any one of the two long edges. The second internally connecting arms 252 substantially and perpendicularly extend from inner walls of the second openings 2511, respectively. The second externally connecting arms 253 curvedly extend from one of the two long edges toward the other one of the two long edges, and a length of each of the second externally connecting arms 253 is preferably larger than ⅓ of a length of each of the two short edges. Specifically, each of the second openings 2511 is arranged between two projection regions defined or obtained by orthogonally projecting two of the second externally connecting aims 253 adjacent to each other onto the plate 251.

It should be noted that any one of the second externally connecting arms 253 of the second shielding member 25 corresponds in position along a normal direction of the plate 251 to two of the signal terminals 22 adjacent to each other. In other words, each of the second openings 2511 of the present embodiment corresponds in position along the normal direction of the plate 251 to at least one of the grounding terminals 23.

The second shielding member 25 is disposed on the front end portion 211 of the insulating frame 21, and connects to the grounding terminals 23 in accordance with the second internally connecting arms 252, so that the second shielding member 25 can be electrically connected to each of the grounding terminals 23. In the present embodiment, the second shielding member 25 is disposed in the accommodating slot 2111 of the front end portion 211, and is disposed adjacent to the parasitic segment 232 of each of the split terminals 23*a*. Moreover, the second internally connecting arms 252 are respectively inserted into and fixed to the elongated gaps G and the second thru-holes 23116, 2312*b* of the grounding terminals 23 (shown in FIG. 7 and FIG. 8) for connecting the second shielding member 25 and the grounding terminals 23. In other words, the first shielding member 24 and the second shielding member 25 can be electrically connected to each other in accordance with the grounding terminals 23.

Specifically, as shown in FIG. 3, FIG. 7, and FIG. 8, in any one of the split terminals 23*a*, the elongated gap G is provided to be inserted with one of the first externally connecting arms 243 and one of the second internally connecting arms 252 both connected to the corresponding first edge 23111 and the corresponding second edge 23211, and any one of the first thru-holes 23115 is provided to be inserted with one of the externally connecting arms 243.

In any one of the split terminals 23*a* of the present embodiment, two of the transverse parts 23112, 23212 of the first edge 23111 and the second edge 23211 are mutually faced and sandwich the corresponding first internally connecting arm 243, and another two of the transverse parts 23112, 23212 of the first edge 23111 and the second edge 23211 are mutually faced and sandwich the corresponding second internally connecting arm 252.

Specifically, the first interference part 23114 and the second interference part 23214 respectively belonging to the two of the transverse parts 23112, 23212 are mutually faced and sandwich the corresponding first internally connecting arm 243, and the first interference part 23114 and the second interference part 23214 respectively belonging to the another two of the transverse parts 23112, 23212 are mutually faced and sandwich the corresponding second internally connecting arm 252, but the present disclosure is not limited thereto. For example, in other embodiments of the present disclosure, the first edge 23111 and the second 23211 can sandwich the first internally connecting arm 243 (or the second internally connecting arm 252) in accordance with two of the erect parts 23113 mutually faced.

Moreover, any of the elongated gaps G in the present embodiment is provided to be inserted with one of the first externally connecting arms 243 and one of the second internally connecting arms 252, but the present disclosure is not limited thereto. For example, in other embodiments of the present disclosure, any of the elongated gaps G can be inserted with at least two of the first externally connecting arms 243 and none of the second internally connecting arms 252; or any of the elongated gaps G can be inserted with none of the first externally connecting arms 243 and at least two of the second internally connecting arms 252.

Accordingly, the parasitic segment 232 and the main segment 231 of the split terminal 23*a* can be electrically connected to each other in accordance with the corresponding first internally connecting arm 243 sandwiched therebetween, so that the electrical connection of the parasitic segment 232 and the main segment 231 have a short signal transmitting path to effectively inhibit the crosstalk. In other words, signals can be transmitted from the parasitic segment 232 across the elongated gap G to the main segment 231 in accordance with the corresponding first internally connecting arm 243 located and inserted in the elongated gap G In addition, signals can be transmitted from the parasitic segment 232 to the main segment 231 in accordance with the second internally connecting arm 252 inserted into the thru-hole 23215, the plate 251, and another second internally connecting arm 252 inserted into the thru-hole 23116.

In addition, as shown in FIG. 2, FIG. 3, and FIG. 7, the front grounding portions 232*b*, the main contact portions 2313, and the parasitic contact portions 2322 of the grounding terminals 23 and the front signal portions 222 of the signal terminals 22 of the transmission wafer 2 are inserted into the insertion portion 11 of the housing 1, the front grounding sheet 242 of the first shielding member 24 is disposed in the insertion portion 11, and at least 80% of an area of the second shielding member 25 and the corresponding components are disposed in the insertion portion 11. In the transmission wafer 2 and the corresponding row of the terminal holes 111, the front grounding portions 232*b* of the grounding terminals 23, the main contact portions 2313, and the parasitic contact portions 2322 and the first externally connecting arms 244 of the first shielding member 24 substantially correspond in position to the grounding thru-holes 112, and the front signal portions 222 of the signal terminals 22 substantially correspond in position to the signal thru-holes 113.

Figure 10:
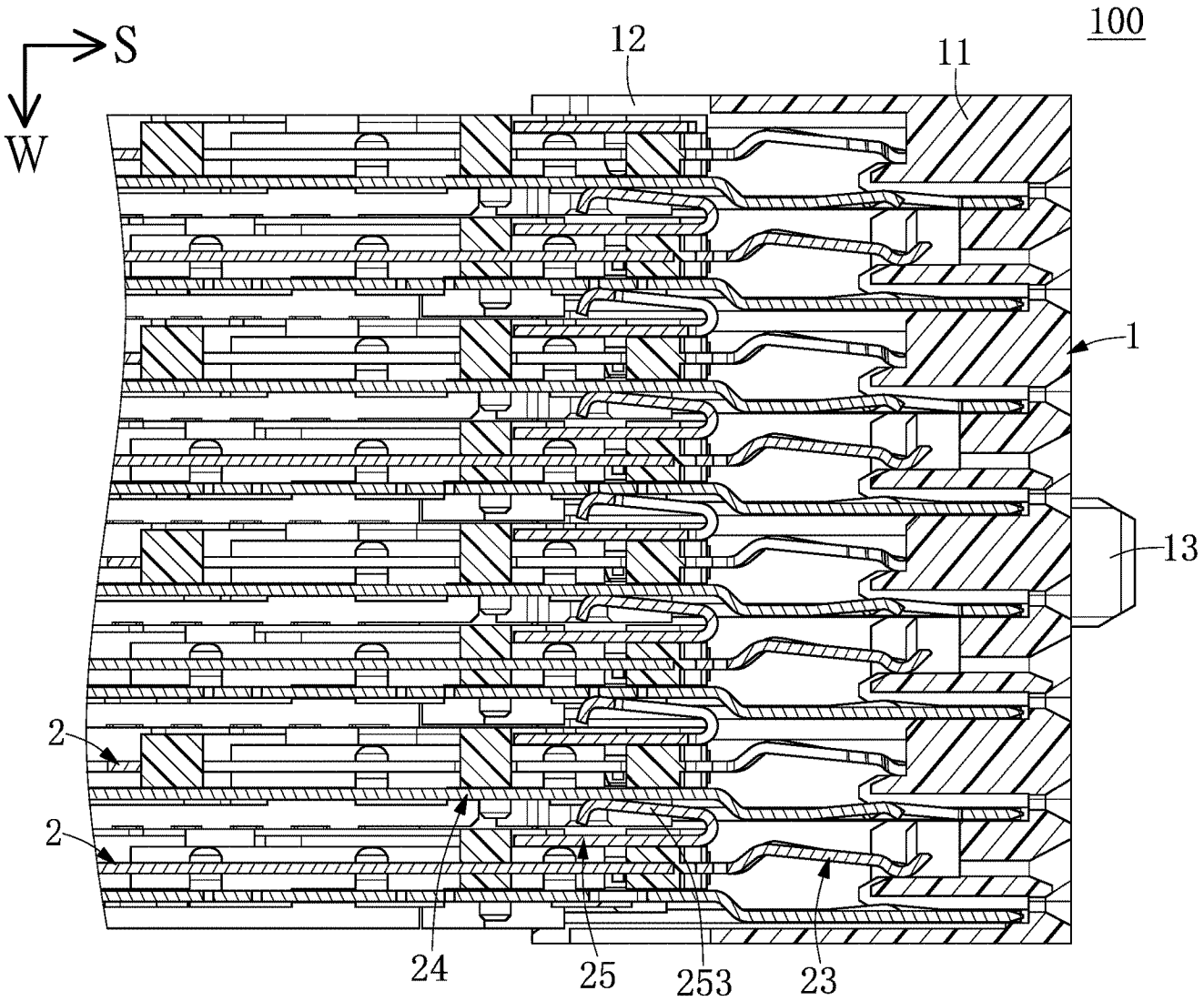
FIG. 10 is a partial cross-sectional view taken along line X-X of FIG. 1.
Figure 11:
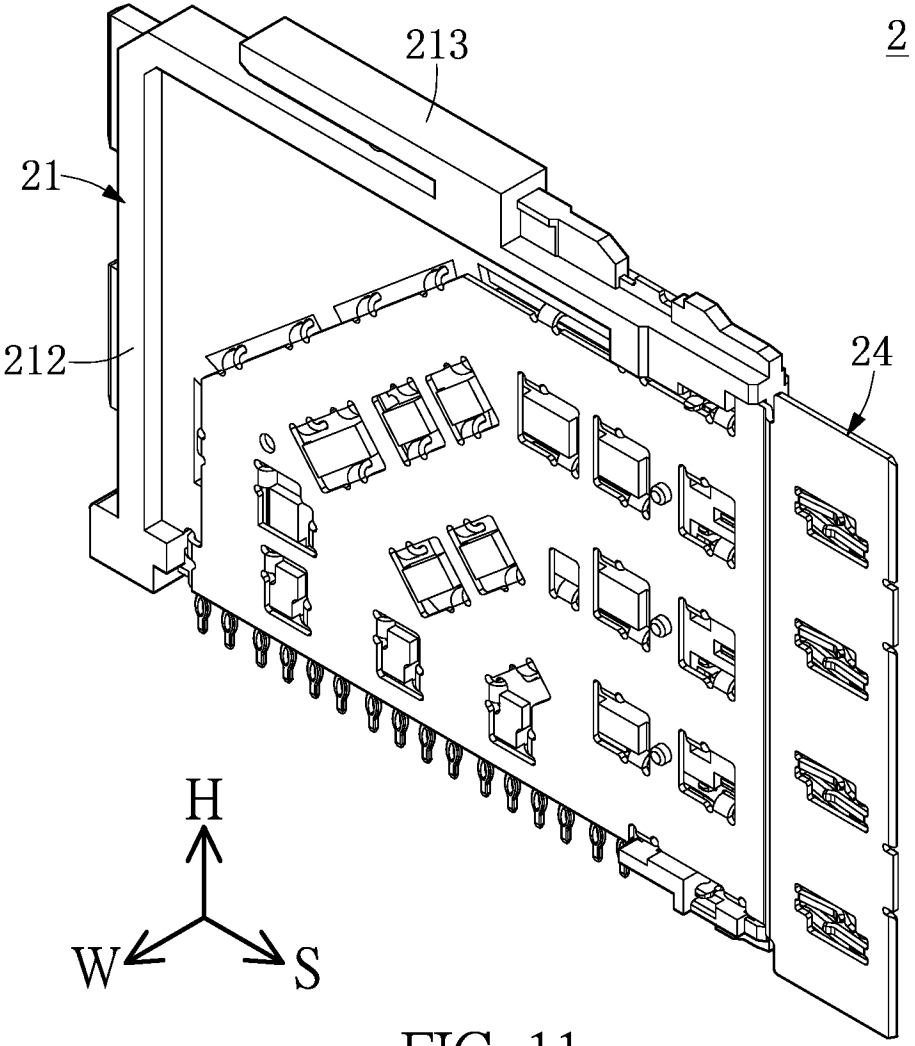
FIG. 11 is a perspective view of a transmission wafer according to a second embodiment of the present disclosure.
Figure 12:
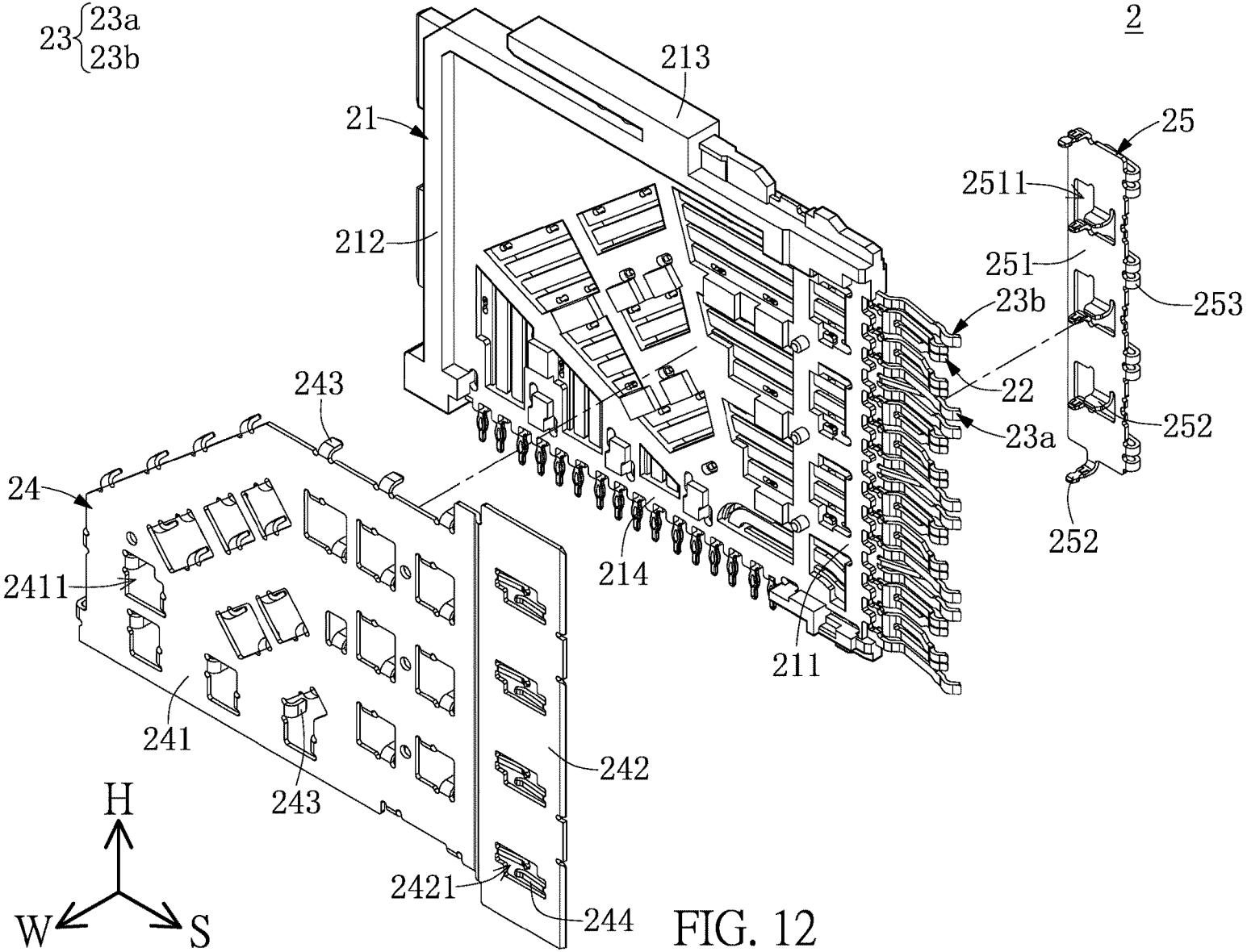
FIG. 12 is an exploded view showing the transmission wafer of FIG. 11.
Figure 13:
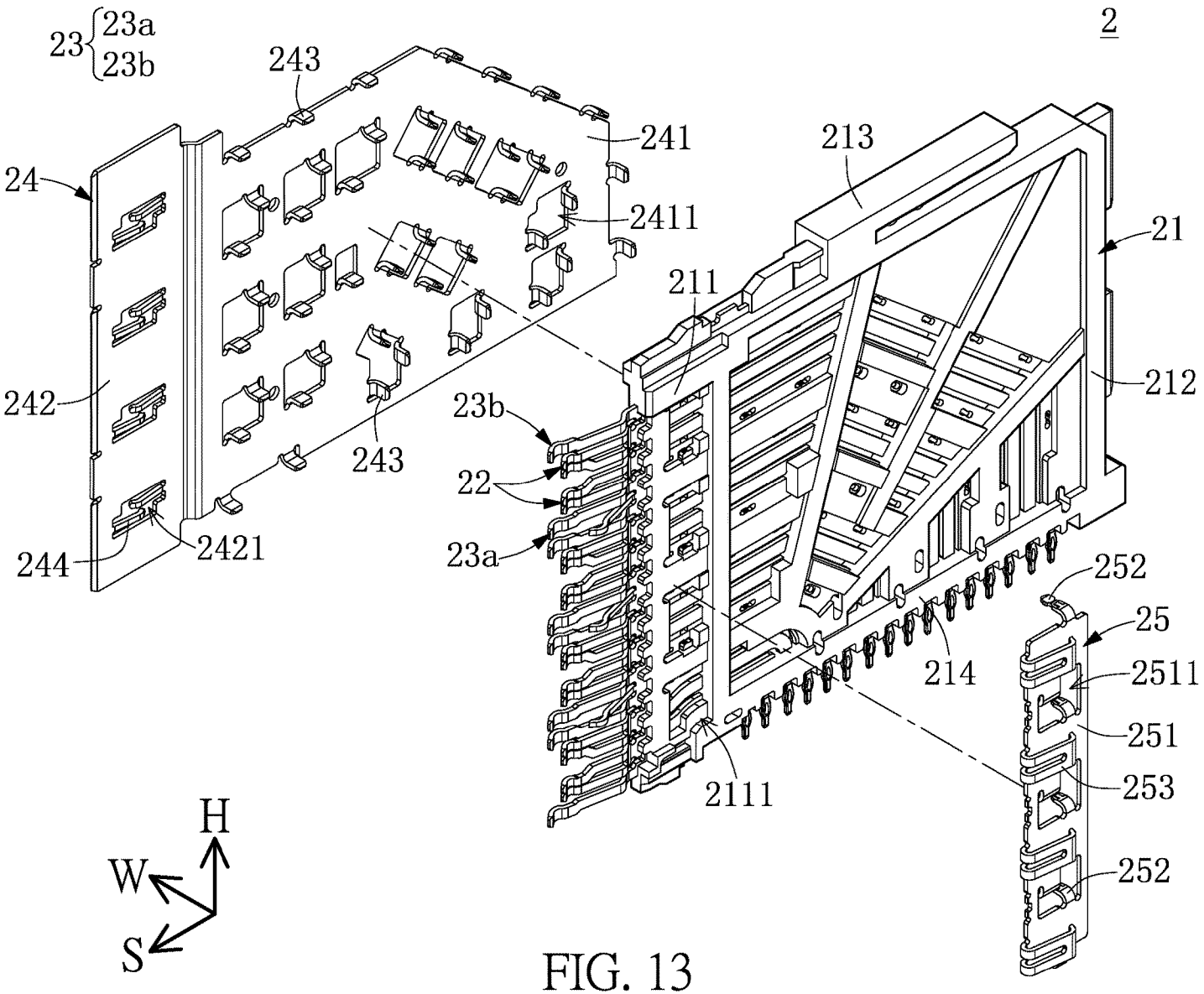
FIG. 13 is an exploded view showing the transmission wafer of FIG. 11 in another angle of view.
Figure 14:
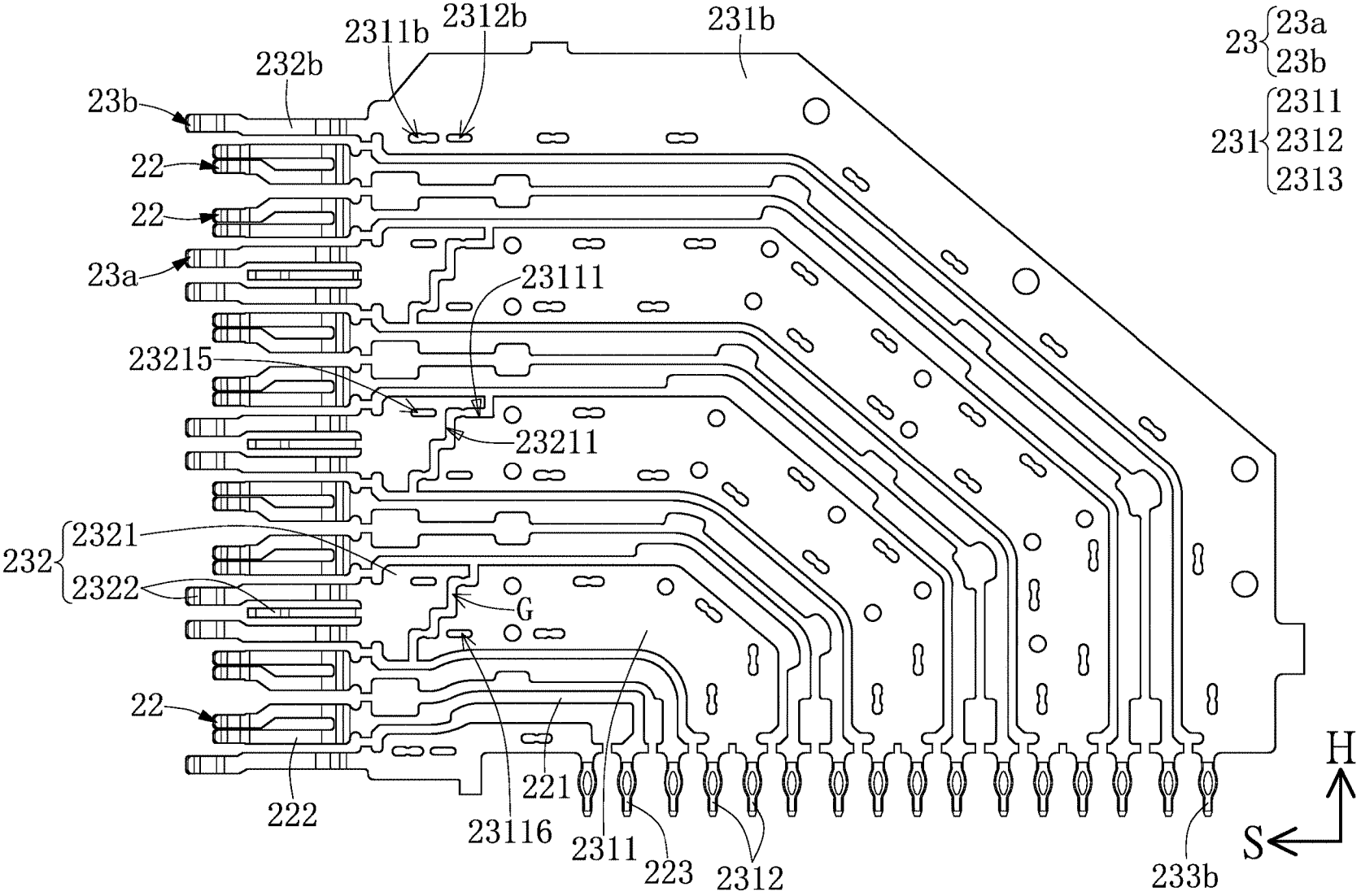
FIG. 14 is a planar view showing the transmission wafer of FIG. 11 when an insulating frame is omitted.

The above description describes the structure of the single transmission wafer 2 of the present embodiment, and the following description proceeds to describe the connection relationship of the transmission wafers 2. As shown in FIG. 2 and FIG. 10, in two of the transmission wafers 2 adjacent to each other (i.e., the two adjacent transmission wafers 2), the second externally connecting aims 253 of the second shielding member 25 of one of the two adjacent transmission wafers 2 are elastically abutted against and electrically connected to the first shielding member 24 of the other one of the two adjacent transmission wafers 2. Accordingly, the first shielding members 24, the second shielding members 25, and the grounding terminals 23 of the two adjacent transmission wafers 2 can be electrically connected to each other to be commonly grounded, so that the crosstalk of the connector 100 can be effectively improved.

Second Embodiment

Referring to FIG. 11 to FIG. 14, a second embodiment of the present disclosure is similar to the first embodiment of the present disclosure, so that descriptions of the same components in the first and second embodiments of the present disclosure will be omitted for the sake of brevity, and the following description only discloses different features between the first and second embodiments.

In the split terminal 23*a* of the present embodiment, a portion of the main segment 231 disposed away from the two tail portions 2312 does not protrude from (the front end portion 211 of) the insulating frame 21, and the first edge 23111 of the main segment 231 is entirely shielded along the insertion direction S in accordance with the fixing portion 2321 of the parasitic segment 232. In other words, a maximum width of the fixing portion 2321 in the height direction H is substantially equal to a maximum width of the main segment 231 in the height direction H. Moreover, the fixing portion 2321 of the parasitic segment 232 has a thru-hole 23215, and the second internally connecting arm 252 is inserted into the thru-hole 23215, and the parasitic segment 232 has a plurality of parasitic contact portions 2322.

In conclusion, at least one of the grounding terminals of the transmission wafer of the connector in the present disclosure is defined as the split terminal and is formed into two separated segments (i.e., the main segment and the parasitic segment), so that the grounding terminals and the insulating frame can be manufactured more easily. Specifically, the parasitic segment and the main segment of the split terminal can be electrically connected to each other in accordance with the corresponding first internally connecting arm sandwiched therebetween, so that the electrical connection of the parasitic segment and the main segment have a short signal transmitting path to effectively inhibit the crosstalk.

The foregoing description of the exemplary embodiments of the disclosure has been presented only for the purposes of illustration and description and is not intended to be exhaustive or to limit the disclosure to the precise forms disclosed. Many modifications and variations are possible in light of the above teaching.

The embodiments were chosen and described in order to explain the principles of the disclosure and their practical application so as to enable others skilled in the art to utilize the disclosure and various embodiments and with various modifications as are suited to the particular use contemplated. Alternative embodiments will become apparent to those skilled in the art to which the present disclosure pertains without departing from its spirit and scope.

What is claimed is:

1. A transmission wafer of a connector, comprising:

an insulating frame;

a plurality of grounding terminals fixed to the insulating frame, wherein at least one of the grounding terminals is defined as a split terminal that includes:

a main segment including a transmission portion fixed in the insulating frame and at least one tail portion extending from the transmission portion to protrude from the insulating frame, wherein the transmission portion has a first edge arranged away from the at least one tail portion; and a parasitic segment separate from the main segment, wherein the parasitic segment includes a fixing portion fixed in the insulating frame and at least one parasitic contact portion extending from the fixing portion to protrude from the insulating frame, and wherein the fixing portion has a second edge arranged away from the at least one parasitic contact portion, and the first edge and the second edge face each other and have an elongated gap therebetween; and a first shielding member disposed on a side surface of the insulating frame and including a plurality of first internally connecting arms respectively connected to the grounding terminals, wherein at least one of the first internally connecting arms is inserted into the elongated gap, and connects to the first edge and the second edge.

2. The transmission wafer according to claim 1, wherein in the split terminal, each of the first edge and the second edge is in a step-like shape, and the first edge geometrically corresponds to the second edge.

3. The transmission wafer according to claim 1, wherein the transmission wafer is configured to be inserted into a mating connector along an insertion direction, wherein in the split terminal, each of the first edge and the second edge has at least one transverse part, and the at least one transverse part of the first edge faces the at least one transverse part of the second edge and is parallel to the insertion direction, and wherein the at least one transverse part of the first edge and the at least one transverse part of the second edge are mutually faced and sandwich the at least one of the first internally connecting arms.

4. The transmission wafer according to claim 1, wherein in the split terminal, the first edge has at least one first interference part, the second edge has at least one second interference part facing the at least one first interference part, and the at least one first interference part and the at least one second interference part sandwich the at least one of the first internally connecting arms.

5. The transmission wafer according to claim 4, wherein two ends of the elongated gap are provided with parts of the insulating frame therein, a portion of the main segments and a portion of the parasitic segment adjacent to the two ends of the elongated gap are embedded in the insulating frame, and the at least one first interference part and the at least one second interference part are exposed from the insulating frame.

6. The transmission wafer according to claim 1, wherein in the split terminal, the transmission portion of the main segment has a plurality of first thru-holes, and at least one of the first thru-holes is inserted with one of the first internally connecting arms.

7. The transmission wafer according to claim 1, wherein in the split terminal, the main segment includes a main contact portion extending from the transmission portion along a direction away from the at least one tail portion to protrude from the insulating frame, and the main contact portion and the at least one parasitic contact portion are spaced apart from and adjacent to each other.

8. The transmission wafer according to claim 1, wherein the number of the at least one parasitic contact portion of the parasitic segment is more than one, and a portion of the main segment arranged away from the at least one tail portion does not protrude from the insulating frame.

9. The transmission wafer according to claim 1, further comprising a second shielding member, wherein the first shielding member and the second shielding member are respectively disposed on two opposite sides of the insulating frame, and the second shielding member is arranged adjacent to the parasitic segment, and wherein the second shielding member includes a plurality of second internally connecting arms respectively connected to the grounding terminals.

10. The transmission wafer according to claim 1, wherein the first edge defines a notch located at a corner of the transmission portion, and the fixing portion is disposed in the notch and is spaced apart from the transmission portion, and a maximum width of the fixing portion in a height direction is less than a maximum width of the main segment in the height direction.

11. The transmission wafer according to claim 1, wherein the first edge of the main segment is entirely shielded along an insertion direction in accordance with the fixing portion of the parasitic segment, a maximum width of the fixing portion in a height direction is substantially equal to a maximum width of the main segment in the height direction, and the insertion direction and the height direction are perpendicular to each other.

12. A connector, comprising:

a housing; and a plurality of transmission wafers arranged in one row and inserted into the housing, wherein at least one of the transmission wafers includes:

an insulating frame;

a plurality of grounding terminals fixed to the insulating frame, wherein at least one of the grounding terminals is defined as a split terminal that includes:

a main segment including a transmission portion fixed in the insulating frame and at least one tail portion extending from the transmission portion to protrude from the insulating frame, wherein the transmission portion has a first edge arranged away from the at least one tail portion; and a parasitic segment separate from the main segment, wherein the parasitic segment includes a fixing portion fixed in the insulating frame and at least one parasitic contact portion extending from the fixing portion to protrude from the insulating frame, and wherein the fixing portion has a second edge arranged away from the at least one parasitic contact portion, and the first edge and the second edge face each other and have an elongated gap therebetween; and a first shielding member disposed on a side surface of the insulating frame and including a plurality of first internally connecting aims respectively connected to the grounding terminals, wherein at least one of the first internally connecting arms is inserted into the elongated gap, and connects to the first edge and the second edge.

* * * * *